United States Patent [19]

Hurst et al.

[11] Patent Number: 4,990,777

[45] Date of Patent: Feb. 5, 1991

[54] ROD ASSEMBLY FOR MULTIPOLE MASS SPECTROMETERS

[75] Inventors: James W. Hurst, San Jose, Calif.; Robert M. Smith; John M. Horth, both of Evergreen, Colo.

[73] Assignee: Finnigan Corporation, San Jose, Calif.

[21] Appl. No.: 487,629

[22] Filed: Mar. 2, 1990

[51] Int. Cl.[5] ..... H01J 49/00

[52] U.S. Cl. ..... 250/292; 250/290; 250/396 R; 313/361.1

[58] Field of Search ..... 250/292, 290, 396 R; 313/361.1, 154, 262

[56] References Cited

U.S. PATENT DOCUMENTS

| | | | |
|---|---|---|---|
| 3,350,559 | 10/1967 | Young et al. | 250/292 |
| 4,700,069 | 10/1987 | Ino et al. | 250/292 |
| 4,870,283 | 9/1989 | Taya | 250/292 |

*Primary Examiner*—Jack I. Berman
*Assistant Examiner*—Kiet T. Nguyen
*Attorney, Agent, or Firm*—Flehr, Hohbach, Test, Albritton & Herbert

[57] ABSTRACT

A multiple rod assembly for multipole mass spectrometers in which the rods are supported in cooperative aligned relationship by ceramic rings with metal rings and brackets.

3 Claims, 2 Drawing Sheets

ROD ASSEMBLY FOR MULTIPOLE MASS SPECTROMETERS

BRIEF DESCRIPTION OF THE INVENTION

This invention relates generally to a rod assembly for multipole mass spectrometers and more particularly to a mounting assembly for rods in a multipole mass spectrometer.

BACKGROUND OF THE INVENTION

Quadrapole mass spectrometers are well known in the art. Generally they employ four parallel rods with suitable AC and/or DC voltages applied between pairs of the rods to generate shaped electric fields in the area between the rods. A beam of charged particles to be analyzed is injected into the electric field at one end of the rods. The electric fields serve to filter the particles whereby only particles of selected mass-to-charge ratio exit from the other end. The mass-to-charge ratio, which is passed is determined by the voltages applied to the rods. The particles exiting the rods are detected and an output signal is generated. By scanning the voltages, the output signal represents a spectrum of the masses which are present in the input beam.

In quadrapole mass spectrometers the selectivity and sensitivity of the mass spectrometer is critically dependent upon accurately spacing the rods from one another in both the circumferential and radial directions. In present practice the rods are supported by ceramic mounts located near each end of the rods. The ceramic mounts are machined to provide grooves which receive the rods. The rods are secured to the ceramic mounts by screws. The screws extend through holes in the ceramic mount and into tapped holes in the rods. Machining required both for the ceramic mount and the tapped holes is relatively expensive and is critical to the proper mounting of the rods. Pairs of rods are then interconnected by metal straps or conductors. Hexapole and octapole mass spectrometers are also known. The rod mounts in such mass spectrometers are substantially more complicated and the accuracy of positioning is more critical.

OBJECTS AND BRIEF DESCRIPTIONS OF THE INVENTION

It is an object of the present invention to provide an improved multiple rod assembly for multipole mass spectrometers.

It is another object of the present invention to provide a multiple rod assembly which includes an improved rod inventory assembly.

The foregoing and other objects of the present invention are achieved by mass spectrometer apparatus in which the alternate rods are supported from metal rings secured to opposite faces of ceramic rings by brackets spot welded between the rods and metal rings.

DESCRIPTION OF PREFERRED EMBODIMENT

Figure 1:
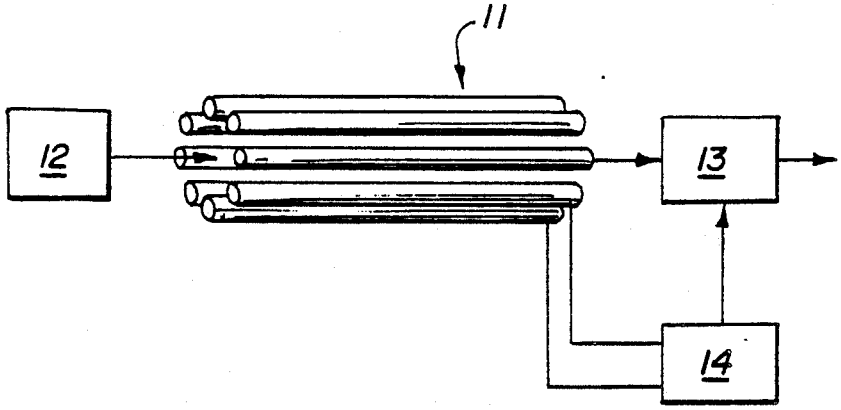
FIG. 1 schematically shows an octapole mass spectrometer in accordance with the prior art.
Figure 2:
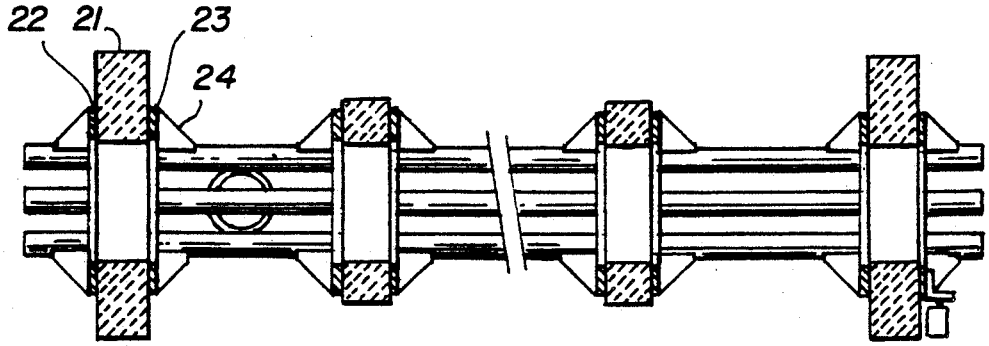
FIG. 2 shows an octapole rod assembly in accordance with the present invention with only three rods shown for clarity.
Figure 3:
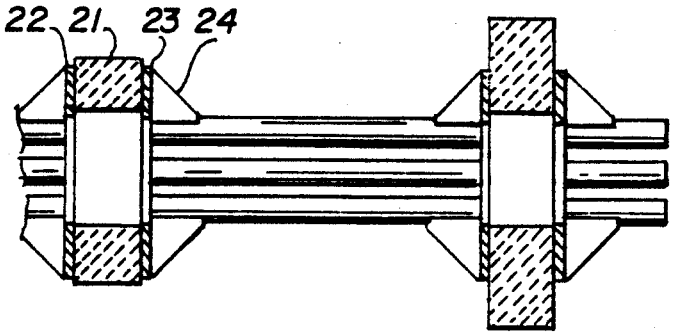
FIG. 3 is an enlarged view of the right hand portion of the rod assembly shown in FIG. 2.
Figure 4:
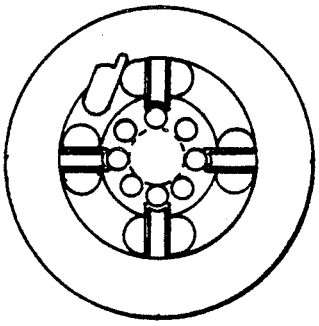
FIG. 4 is an end view of the rod assembly shown in FIG. 3.

Referring to FIG. 1, an octapole mass spectrometer is schematically illustrated. The spectrometer includes spaced parallel rods 11. An ion source 12 injects charged particles along the central axis of the rods. The exiting ions are detected and the signal processed by the detector processing electronics 13. Control voltages are applied to the rods by the source 14 which also applies voltage to the processing electronics 13. Operation of mass spectrometers of the type described are well known and will not be further described.

In accordance with the present invention a novel rod assembly is provided. The rods are supported in spaced relationship by rod support assemblies which include a ceramic ring 21 with metal rings or washers 22 and 23 suitably secured to the faces of the ceramic ring. The metal rings may for example be secured to the faces of the ceramic ring by epoxy. The metal and ceramic rings are coaxially aligned in a suitable fixture during assembly.

Figure 5:
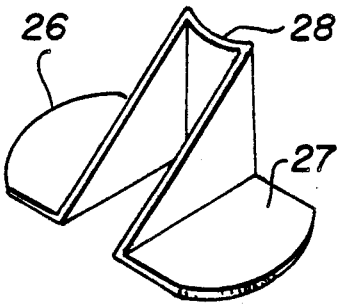
FIG. 5 is a perspective view of a bracket used to mount the rods in the assembly of the present invention.

L-shaped brackets 24 which retain the rods, as will be shortly described, are spot welded to the metal rings at a precise location. The brackets in FIG. 5 include base tabs 26,27 which are spot welded to the rings and a saddle 28 which receives and is spot welded to the rods. In an octapole rod assembly four brackets are spaced at 90° from one another on each of the metal rings with the brackets on one ring displaced 45° with respect to the other ring. The brackets are positioned by employing a fixture which has eight accurately spaced short rods. The metal and ceramic ring assembly is placed over the short rods. The brackets on one ring are abutted against alternate rods and the base welded to the metal rings whereby the brackets are accurately positioned circumferentially around the rings. The assembly is then turned over and the other four brackets are abutted against their respective rods and spot welded to the associated metal ring.

Figure 6:
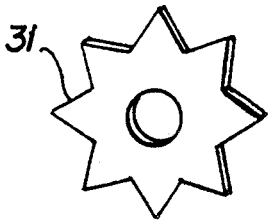
FIG. 6 is a star-shaped positioning washer used in assembling the rod assembly of the present invention.
Figure 7:
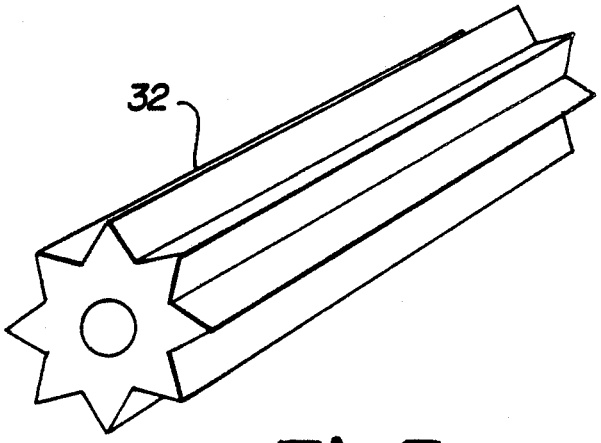
FIG. 7 is a perspective view of a star-shaped rod used in assembling the rod assembly of the present invention.

The octapole rods are then accurately aligned and temporarily secured to a support structure. For example, the rods may be aligned and spaced by placing them on and clamping them to an accurately machined star structure including a star shaped washer 31, FIG. 6 and a star shaped rod 32, FIG. 7. When they have been aligned and clamped to the star shaped washer and rod, the rods may be secured to the washers and rod by a suitable adhesive. The clamps are then removed. The mounting assembly of ceramic ring, metal rings and brackets is slid over the rods and the saddles spot welded to the rods. The next step is to remove the adhesive with a suitable solvent and then remove the positioning rod and stars from the interior of the octapole assembly. The octapole rod assembly is now accurately aligned and ready for installation into a mass spectrometer. Alternate rods are electrically interconnected in common via the brackets and associated metal rings.

It is apparent that the same assembly technique of ceramic and metal rings with brackets supporting rods from the metal can be used for other multiple spectrometer assemblies such as hexapoles and quadrapole rod assemblies for multipole mass spectrometers.

We claim:

1. A rod assembly for use in multipole mass spectrometers comprising:

a plurality of aligned and spaced rods;

a plurality of rod mounting assemblies spaced along said plurality of rods for engaging and supporting said rods in spaced relationship;

each of said mounting assemblies comprising a ceramic ring having first and second faces, a metal ring secured to each of said faces in coaxial alignment with the ceramic rings and metal brackets extending between each of said rings and said rods to engage and support alternate rods from each of said metal rings.

2. A rod assembly for multiple mass spectrometers as in claim 1 when brackets are spot welded to said rings and to the rods.

3. A rod assembly for multipole mass spectrometers as in claim 1 when the metal rings are secured to the ceramic rings by an adhesive.

* * * * *

UNITED STATES PATENT AND TRADEMARK OFFICE

CERTIFICATE OF CORRECTION

PATENT NO. : 4,990,777

DATED : February 5, 1991

INVENTOR(S) : James W. Hurst, Robert M. Smith, John M. Horth

It is certified that error appears in the above-identified patent and that said Letters Patent is hereby corrected as shown below:

Column 1, line 13, change "Quadrapole" to --Quadrupole--
Column 1, line 27, change "quadrapole" to --quadrupole--
Column 3, line 2, change "quadrapole" to --quadrupole--

Signed and Sealed this

Eighth Day of September, 1992

*Attest:*

DOUGLAS B. COMER

*Attesting Officer*

*Acting Commissioner of Patents and Trademarks*